United States Patent [19]

Orsatti

[11] Patent Number: 4,881,735

[45] Date of Patent: Nov. 21, 1989

[54] SAFTEY BASE

[75] Inventor: Louis A. Orsatti, Laguna Hills, Calif.

[73] Assignee: Adams, U.S.A., Inc., Cookeville, Tenn.

[21] Appl. No.: 208,244

[22] Filed: Jun. 17, 1988

[51] Int. Cl.[4] ..... A63B 71/02

[52] U.S. Cl. ..... 273/25

[58] Field of Search ..... 273/25

[56] References Cited

U.S. PATENT DOCUMENTS

| | | | |
|---|---|---|---|
| 3,572,705 | 3/1971 | Wyble | 273/25 |
| 4,398,714 | 8/1983 | Fuller et al. | 273/25 |
| 4,493,486 | 1/1985 | Fuller et al. | 273/25 |

OTHER PUBLICATIONS

The Sporting News, Sep. 5, 1970, "Double Bag at First Base".

*Primary Examiner*—William H. Grieb

*Attorney, Agent, or Firm*—Stetina and Brunda

[57] ABSTRACT

Disclosed is an improved double-width base pad comprising two separate single-width base pad members joined along abutting lateral edges so as to form a desired double-width base pad. Preferably, the individual single-width base pad members comprise pliable outer covers or skins having generally flexible inner cores inserted therein. Rigid elongate bars are positioned inside each pliable skin, along one lateral edge thereof. Attachment means such as bolts are passed through the elongate bars and through the lateral edges of the individual base pad skins so as to join the individual bar pad members in an edge-to-edge fashion. The disposition of the elongate bars within the pliable skins serves to distribute joinder stresses along the abutting lateral edges of the skins, thereby avoiding tearing thereof. Rigid attachment bars on the exterior of the individual skins may be alternately or additionally employed.

7 Claims, 1 Drawing Sheet

SAFTEY BASE

BACKGROUND OF THE INVENTION

This invention relates generally to an improved base for playing baseball, softball, and similar sports. More particularly, the invention pertains to an improved double-width safety base wherein two single-width base pad members are connected in an edge-to-edge fashion.

It has become known that the use of a typical single-width base pad at first base, is associated with a high incidence of various injuries due to collisions between the base runner and the first base man or fielder. In an effort to minimize the frequency of such injuries, especially in youth baseball programs, it is known to use a double-width bag at first base so that the fielder may tag an inner portion of the bag while the advancing runner may tag an outer portion of the bag. Generally, such double-width base pads are multicolored so as to display a dividing line in the middle with either side of the base pad being distinguished by a different color. Accordingly, the base runners may be instructed to tag the portion of the bag which exhibits color A while the fielders may be instructed to tag that portion of the bag which exhibits color B. Such arrangement is believed to prevent the occurrence of many collisions and injuries when plays are made at the base.

Examples of double-width base pads of the prior art are found in U.S. Pat. Nos. 4,398,714 (Fuller et al. I) and 4,493,486 (Fuller et al. II). The prior art double-width base pads disclosed in these United States patents are of unitary double-width construction. As such, these prior art double-width base pads comprise a single base pad member, twice the normal width. Of course, the manufacture of such unitary double-width base pads requires special double-width tooling, double-width handling equipment, special manufacturing methods, etc.

In view of the need for special tooling, equipment, and manufacturing methods to produce the unitary double-width base pads of the prior art, there exists a present need in the art for an improved double-width base pad which may be formed of two separate standard-sized base members such that it may be manufactured using standard-sized base pad tooling, existing standard-sized processing equipment and at least some of the established handling methods heretofore employed.

SUMMARY OF THE INVENTION

The present invention provides an improved double width safety base pad comprising two separate base pad members joined in an edge-to-edge fashion. Because the individual base pad members are of standard size and configuration, the standard-sized base pad tooling and equipment of the prior art may be used for the manufacture, handling, and production thereof. Nonetheless, the inventive manner in which edge-to-edge joinder of the individual single-width base pads is accomplished results in a double-width base pad structure which is sufficiently rigid and durable to be employed in any conventional manner.

The double-width safety base pad of the present invention generally comprises individual first and second base pad members, each such base pad member being formed generally of a durable, pliable outer cover or "skin" and a flexible inner core. The pliable outer cover of each single-width base pad comprises a generally flat horizontal top surface, a plurality of generally vertical edges, and a plurality of stabilizing flaps extending around the underside thereof. Such pliable cover is positionable over a preformed flexible core. Such flexible core is generally made of flexible polyurethane foam or similar material. Additionally, a pliable bottom skin may be applied to the underside of the formed skin so as to form a sealed, fully enclosed base pad.

The manner in which the two single base pads are joined in the present invention provides a double-width base pad of sufficient rigidity and strength to be usable in baseball/softball diamonds whereupon all calibers of play take place. Also, the present invention provides a double-width base pad which may be manufactured inexpensively, with minimal capital investment and excellent part-to-part reproduceability.

In accordance with the invention, two individual single-width base pad members are joined together in an edge-to-edge fashion by inserting elongate bar members under the outer skins or outer covers thereof such that each elongated bar will reside along a respective lateral edge of each single-width base pad member. Each elongate bar is provided with a plurality of bolt receiving apertures. Corresponding apertures are formed along the lateral edge of each base pad skin or cover such that bolts may be passed (a) through the apertures formed in the elongate member positioned under the first outer skin or cover and along an edge of the first base member, (b) through the apertures formed on one lateral edge of the first outer base pad skin or cover, (c) through the corresponding apertures formed on an abutting lateral edge of the second outer base pad skin or cover, and (c) through the corresponding apertures of a second elongate member positioned under the second outer skin or cover and along the abutting lateral edge thereof. Suitable fasteners, such as lock washers and nuts are then threaded onto the free ends of the bolts within the second base member so as o firmly join the outer skins or covers of the first and second base members in an edge-to-edge fashion.

After the outer skins or covers of the first and second base pad members have been so joined, flexible inner cores are inserted therein. Also, a vinyl bottom sheet may be attached over the open bottom of each outer cover or skin so as to fully envelope and enclose the flexible core.

A rigid core insert is disposed in the mid-region of each flexible base pad core so as to form a rigid tie-in structure to which an underside base plate and base pad mounting sleeve may be connected.

The base plates and under-positioned mounting sleeves used on the double-width base pad of the present invention may be of the same type as those used with single-width base pads. Accordingly, two separate base plates and mounting sleeves may be employed--one base plate and one mounting sleeve on the underside of each individual base pad unit. Alternatively, a single base plate and mounting sleeve may be connected to one of the individual base pad members while the remaining base pad member will be left without an underside connector. By such arrangement, the double-width base pad of the present invention may be employed on a baseball or softball field whereupon only one base mounting fitting is present at the desired base position.

Further, in accordance with the present invention, rigid attachment bars may be connected between the first and second single-width base pad members. Such rigid attachment bars will generally be in the form of flat channel members formed of rigid material such as steel. Such rigid attachment bars will increase the rigidity of the double-width base pad and will reduce or eliminate any unnecessary movement between the individual single-base pad members which make up the double-width base pad of the present invention.

Accordingly, a principal object of the invention is to prevent injuries resulting from collisions between base runners and fielders during baseball and softball games.

Another object of the invention is to provide an improved double width base pad wherein individual single-width base pad members are joined in an edge-to-edge fashion.

A further object of the invention is to provide an improved double-width base pad which may be manufactured in a reproducible and inexpensive manner.

A still further object of the invention is to eliminate the need for special double-width tooling, special equipment, modified handling methods, etc. in the manufacture and distribution of double-width base pads.

Yet another object of the present invention is to provide a double-width base pad which is of rugged, durable construction so as to be able to withstand extended periods of normal outdoor use.

Still another object of the invention is to provide a double-width first base pad which is formed of two individual single-width base pad and wherein such single-width pad members are individually identical or substantially similar in construction to the single-width base pads which are singly positioned at the second and third base positions.

Further objects and advantages of the invention will become apparent to those skilled in the art upon reading and understanding of the following detailed description and consideration of the accompanying drawings.

DETAILED DESCRIPTION OF THE PREFERRED EMBODIMENTS

Figure 1:
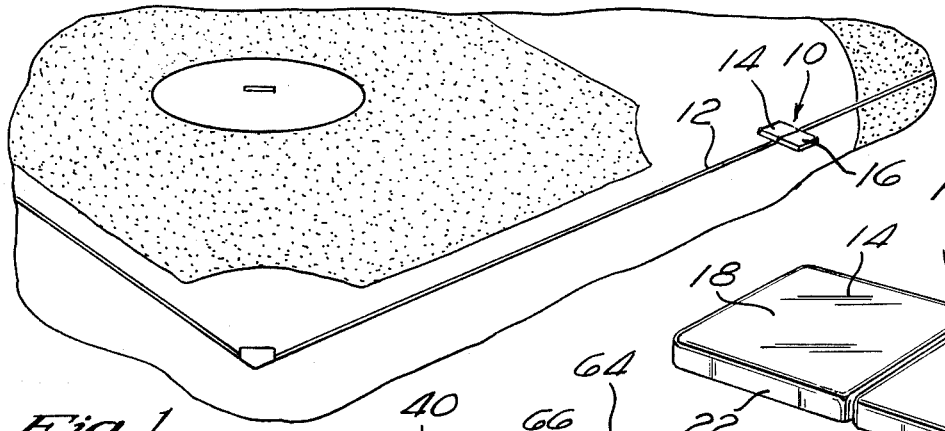
FIG. 1 is a perspective view of a portion of a baseball diamond having a double-width base of the present invention positioned at first base.

The accompaning drawings are provided for purposes of illustrating presently preferred embodiments of the invention and not for purposes of limiting its scope. Accordingly, FIG. 1 depicts a portion of a baseball or softball diamond wherein a double-width base pad 10 of the present invention is positioned at first base. As shown, the double-width base pad is positioned partially within the defined base path such that the base line 12 runs through the midpoint of the double-width pad. Thus, the base line bisects the double-width base pad such that one of the component single-width base pad members 14 lies on one side of the base line 12 while the other component single-width base pad member 16 lies on the opposite side of base line 12. Such positioning is, however, subject to modification depending upon individual desire, prevailing ground rules, and/or the positioning and availability of any underlying mounting fixtures. Thus, the double-width base pad of the present invention could be positioned such that one single-width base pad member is aligned wholly within the base path in the conventional manner while the remaining single-width base pad member extends either inside or outside of the base path.

Figure 2:
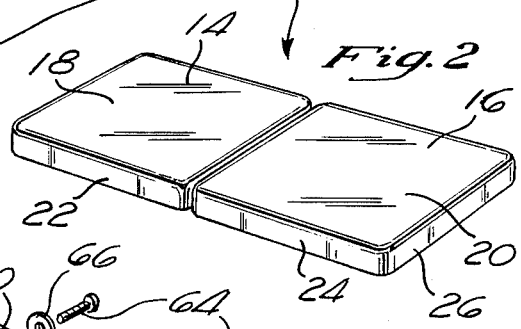
FIG. 2 is a perspective view of a preferred double-width base pad of the present invention.

As seen in FIG. 2, the preferred double width base pad 10 of the present invention comprises two single-width base pad members 14 and 16 joined in an abutting edge-to-edge fashion Each separate base pad member 14 or 16 has a generally flat upper surface 18, 20 with a plurality of vertically extending lateral edges 22, 24, 26. Each individual base pad 14, 16 is generally of square configuration. The individual base pad members 14, 16 are joined, edge-to-edge, in a rigid and sturdy manner so as to form the desired double-width safety base pad 10 of the present invention. The main body of each individual base pad 14, 16 generally comprises a pliable yet durable outer skin with a flexible core positioned therein. The pliable outer skins of this preferred embodiment are formed of molded polyvinylchloride (PVC) material which typically are provided in differing colors to delineate the same from one another.

The edge-to-edge joinder of the individual base pad members 14 and 16 is effected by joining abutting lateral edges of the individual outer skins prior to insertion of the individual flexible cores. The manner in which the outer skins are initially joined is specifically shown in the exploded view of FIG. 3

Figure 3:
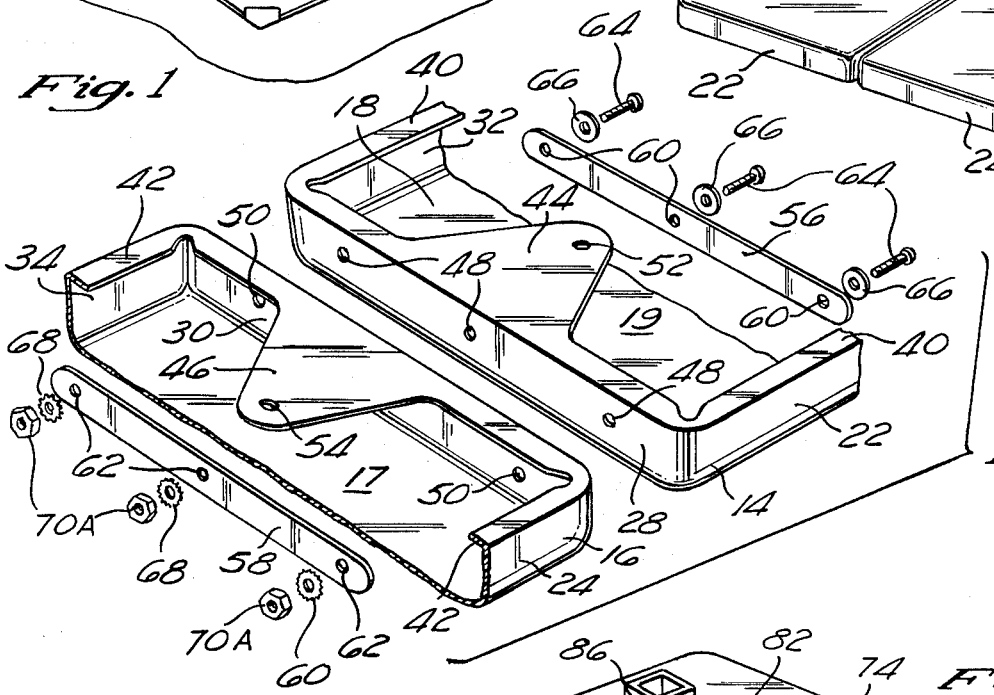
FIG. 3 is a cutaway exploded view of the means by which two individual base pad covers or skins are rigidly joined to form a preferred double-width base pad cover of the present invention.
Figure 4:
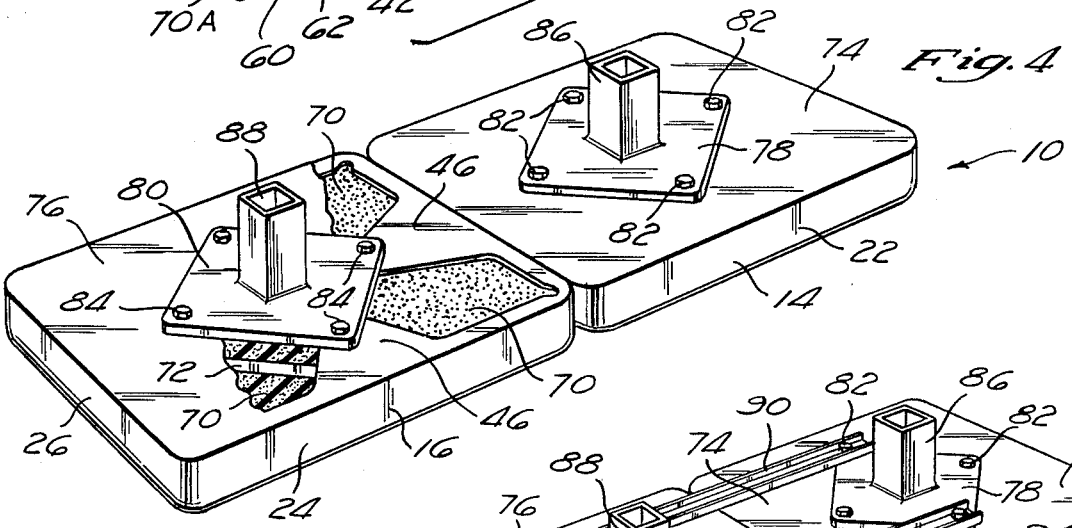
FIG. 4 is a cutaway perspective view of the underside of a preferred, fully assembled double-width base pad of the present invention.

Referring to FIG. 3, the outer skins of the individual base pads 14, 16 are shown in inverted orientation. Each outer skin defines a flat upper panel 17, 19 which defines the upper surface 18, 20 of the base pad on the upper side thereof and lateral edges 22, 24, 26, 28, 30, 32, 34 of the individual single-width base pad members 14, 16. As shown, underside lips 40, 42 extend horizontally under the bottom of each lateral edge. Generally triangular stabilizer tabs 44, 46 extend inwardly from the midportion of each underside lip 40, 42 so as to provide bottom attachment points for the outer skin.

After the skins have been molded, deflashed, and finished, a plurality of holes 48, 50 are formed through one lateral edge 28, 30 of each individual skin. Also, individual holes 52, 54 are formed during molding, near the apex of each of the individual triangular stabilizing flaps 44, 46.

The apertured edges 28, 30 of the individual single-width base pad skins are juxtapositioned and abutted together such that the apertures 48 of one edge of one skin are in direct alignment with the apertures 50 on one edge of another skin.

Elongate bars 56, 58 are provided with pluralities of holes 60, 62. Such holes 60, 62 are sized, configured, and positioned to be directly analogous to and alignable with the holes 48, 50 formed in the abutting lateral edges 28, 30 of the outer base pad skins. Such elongate bars 56, 58 serve to evenly distribute the joinder stresses along the lateral edges of the separate base pad members 14, 16. After the elongate bars 56, 58 have been so positioned, bolts 64 are passed through individual washers 66 and apertures 60, 48, 50, and 62. Thereafter, lock washers 68 and nuts 70A are threaded onto each of the bolts 64 so as to firmly join the skins along their abutting edges 28 and 30. The use of the rigid elongate bars 56, 58 provides for even distribution of stress over the entire edge 28, 30 of each outer skin so as to prevent tearing or stretching of the skin material in the regions of the individual apertures.

After the outer skins have been joined in the above-described edge-to-edge manner, a core 70 of flexible polyurethane foam is inserted into each individual base pad member 14, 16. A rigid plastic core insert 72 is disposed during molding near the center of each foam core 70 so as to provide a stationary attachment member within the inner confines of each of the single-width base pad members 14, 16.

The rigid plastic core inserts 72 may be formed in place at the time an individual flexible urethane foam core 70 is cast or molded. Alternatively, the rigid core insert 72 may be positioned within a cut section of polyurethane bunstock or a precut pad of rebonded urethane foam particles. By either method, the rigid core insert 72 will be held in its desired position at the center of the inner core 70 so as to provide a stable tie-in member to which underlying support and connecting structures may be attached.

The rigid core insert 72 employed in this preferred embodiment is generally diamond-shaped and is provided with a single round aperture at each corner thereof. Such single apertures of the core insert are directly alignable with the individual apertures.52, 54 of the four triangular stabilizing flaps 44, 46 which extend from the underside of the outer skin.

After the flexible foam core 70 and rigid core insert 72 have been positioned within the molded PVC skin, a generally square section of PVC sheet 74, 76 is cemented or heat-formed over the bottom surface of each individual single-width base pad 14, 16 so as to fully enclose the inner core. Thereafter, diamond-shaped base plates 78, 80 are positioned centrally on the bottom surface of each base pad 14, 16. Each base plate 78, 80 is provided with apertures at each corner thereof. The base plates 78, 80 are sized, configured, and positioned such that the corner apertures are directly aligned with the underlying stabilizer flap apertures 52, 54 and the corresponding core insert apertures 72. Screws or bolts 82, 84 are then passed through the corner apertures of base plates 78, 80 through apertures 52, 54 of the underlying stabilizer flaps 44, 46, and into the internally positioned rigid core inserts 72. Each screw or bolt 82, 84 will firmly tie into the underlying rigid core insert 72 so as to firmly affix a base plate 78, 80 to the underside of each individual base pad member 14, 16.

Mounting sleeves 86, 88 are formed on the undersides of the base plates 78, 80. Such mounting sleeves 86, 88 are insertible into a corresponding receiving or mounting fixture which is positioned within the ground at the desired base position.

Figure 5:
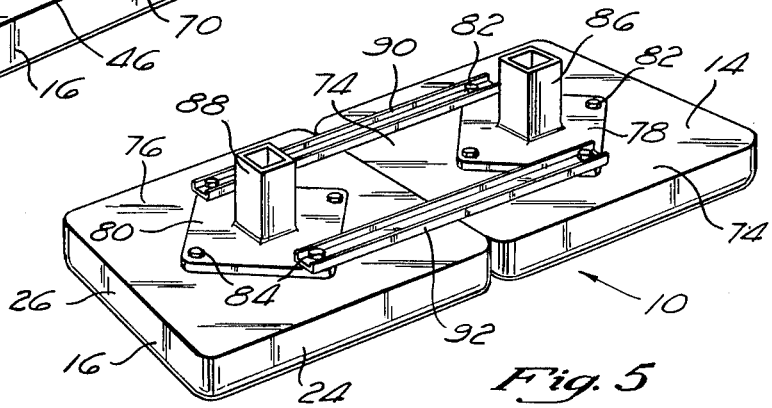
FIG. 5 is a perspective view of the underside of an alternative preferred double-width base pad of the present invention wherein rigid attachment bars extend between the individual single-width base pad members

In the alternative preferred embodiment shown in FIG. 5, attachment bars 90, 92 have been applied to the above-described double-width base pad of the present invention. Such attachment bars are formed of rigid metal channel. Each bar 90, 92 extends between base plate 78 of one single-width base pad member 14 and base plate 80 of the attached single-width base pad member 16. The rigid attachment bars 90, 92 are affixed to each base pad member 14, 16 by passing individual bolts 82, 84 therethrough. By such arrangement, the attachment bars 90, 92 will be firmly connected to the individual base members 14, 16 so as to impart rigidity and strength to the double-width base 10 of the present invention.

The attachment bars 90, 92 may be used in conjunction with, or as an alternative to, the above-described means of joining the abutting edges of the PVC skins through the use of elongate bar inserts 56, 58 and the corresponding bolts 64 pass therethrough.

As described herein and shown in the drawings, the present invention is formed by connecting two single-width base pad outer skins or base pad members in an edge-to-edge fashion. The individual single-width outer skins are manufactured by previously known methodology using existing tooling and equipment. By joining the individual base pads or the outer skins thereof rather than manufacturing a unitary double-width base member, the present invention results in substantial savings of money that would otherwise be invested in capital equipment, tooling, and the like.

Although the present invention has been described herein with reference to specifically preferred embodiments, it should be appreciated that numerous modifications and alterations may be made to such preferred embodiments without departing from the spirit and scope of the invention. For example, the joinder of the abutting edges of the individual PVC outer skins may be made by means other than the elongate bar bolt system described above. Indeed, various types of hardware and connectors may be employed to effect the desired edge-to-edge joinder of the outer skins. Also, although the outer skins of this preferred embodiment are formed of molded vinyl material, it must be appreciated that many other materials such as canvas or other plastics may be employed Likewise, materials other than urethane foam may be used in the manufacture of the flexible inner core Accordingly, it is intended that any and all such modifications and alterations, including those specifically enumerated above, be included within the scope of the appended claims and the equivalents thereof. Having thusly described the invention,

What is claimed is:

1. A double-width base pad comprising:

first and second single-width base pad members, each having a pliable outer skin defining a generally horizontal upper surface and a plurality of lateral edges and a resilient inner core positioned within said pliable outer skin; and a means for connecting the first single-width base pad member to the second single-width base pad member such that one lateral edge of the first single-width base pad member abuts one lateral edge of the second single-width base pad member, thereby forming the desired double-width base pad;

wherein said means for connecting the first single-width base pad member to the second single-width base pad member comprises:

a first elongate bar positioned inside the pliable outer skin and along a selected lateral edge of the first single-width base pad member;

a second elongate bar positioned inside the pliable outer skin and along a selected lateral edge of the second single-width base pad member;

a plurality of individually alignable apertures extending through said first and second elongate bars and the respective selected lateral edges of the first and second single-width base members; and a plurality of connecting members passing through said alignable apertures so as to connect the first single-width base pad member to the second single-width base pad member such that the respective selected lateral edges thereof will be held in abutment with one another, thereby forming the desired double-width base member.

2. The double-width base pad of claim 1 wherein said first and second single-width base pad members differ in color so as to form a double-width base pad which is half one color and half another color.

3. The double-width base pad of claim 1 wherein said first and second elongate bars comprise sections of steel flat bar.

4. The double-width base pad of claim 1 wherein said apertures comprise round holes arranged in a single linear array.

5. The double-width base pad of claim 4 wherein said linear array comprises three single apertures.

6. The double-width base pad of claim 1 wherein said connecting members comprise screws with appropriate lock washers and nuts threaded thereon.

7. The double-width base pad of claim 1 wherein said connecting means comprise bolts with appropriate lock washers and nuts threaded thereon.

* * * * *